US008105179B1

(12) United States Patent
Allen

(10) Patent No.: US 8,105,179 B1
(45) Date of Patent: Jan. 31, 2012

(54) GOLF CLUB HAVING IMPROVED HANDLE CONFIGURATION

(76) Inventor: Donald T. Allen, Norman, OK (US)

( * ) Notice: Subject to any disclaimer, the term of this patent is extended or adjusted under 35 U.S.C. 154(b) by 0 days.

(21) Appl. No.: 13/151,978

(22) Filed: Jun. 2, 2011

(51) Int. Cl.
*A63B 53/16* (2006.01)

(52) U.S. Cl. ..... 473/294; 473/295; 473/296; 473/298

(58) Field of Classification Search ..... 473/294–296, 473/298, 300–303, 549, 551, 552, 568; 16/421, 16/430, DIG. 18, DIG. 19, DIG. 12, DIG. 24; 81/489; 74/551.9; D8/DIG. 6, DIG. 7, DIG. 8; D21/756
See application file for complete search history.

(56) References Cited

U.S. PATENT DOCUMENTS

| | | | | | |
|---|---|---|---|---|---|
| 2,011,896 | A | | 8/1935 | Grace | |
| 2,204,974 | A | * | 6/1940 | Strasser | 473/293 |
| 2,938,728 | A | | 5/1960 | Green | |
| 3,462,155 | A | * | 8/1969 | Pelz | 473/238 |
| 3,533,630 | A | | 10/1970 | Monaco | |
| 4,215,860 | A | * | 8/1980 | Nakamatsu | 473/201 |
| 4,767,141 | A | * | 8/1988 | Martin | 294/50 |
| 4,930,181 | A | | 6/1990 | Johnson | |
| 4,958,407 | A | | 9/1990 | Johnson | |
| 5,106,095 | A | | 4/1992 | Pitkethly | |
| 5,328,185 | A | | 7/1994 | Finnigan et al. | |
| 5,388,834 | A | | 2/1995 | Dawson | |
| 5,669,823 | A | | 9/1997 | McCready | |
| 5,975,602 | A | * | 11/1999 | Zan | 294/54.5 |
| 6,343,997 | B1 | | 2/2002 | Allen | |
| 6,599,200 | B1 | | 7/2003 | Kallassy | |
| 6,793,589 | B1 | | 9/2004 | Yerelian | |
| 6,798,348 | B1 | | 9/2004 | Wilker et al. | |
| 7,081,053 | B2 | | 7/2006 | Kallassy | |
| 7,635,309 | B2 | | 12/2009 | Akavak | |
| 7,674,185 | B2 | | 3/2010 | Omidi | |
| 2006/0079341 | A1 | | 4/2006 | Mansour | |
| 2011/0014990 | A1 | | 1/2011 | Malcolm | |

* cited by examiner

*Primary Examiner* — Stephen L. Blau
(74) *Attorney, Agent, or Firm* — Blank Rome LLP

(57) ABSTRACT

An apparatus and method for an improved handle configuration are disclosed. The apparatus and method include an upper handle secured to a shaft that has a longitudinal axis and a lower handle secured to the shaft opposite the upper handle at a location spaced from the upper handle along the longitudinal axis of the shaft. The upper handle and lower handles each have grip portion that extends at an angle substantially orthogonal to the longitudinal axis and that is spaced apart from the shaft in a plane that is substantially perpendicular to the longitudinal axis. The upper handle and lower handle are secured to the shaft at an end of the shaft opposite a device configured to contact an object when the shaft is swung.

11 Claims, 5 Drawing Sheets

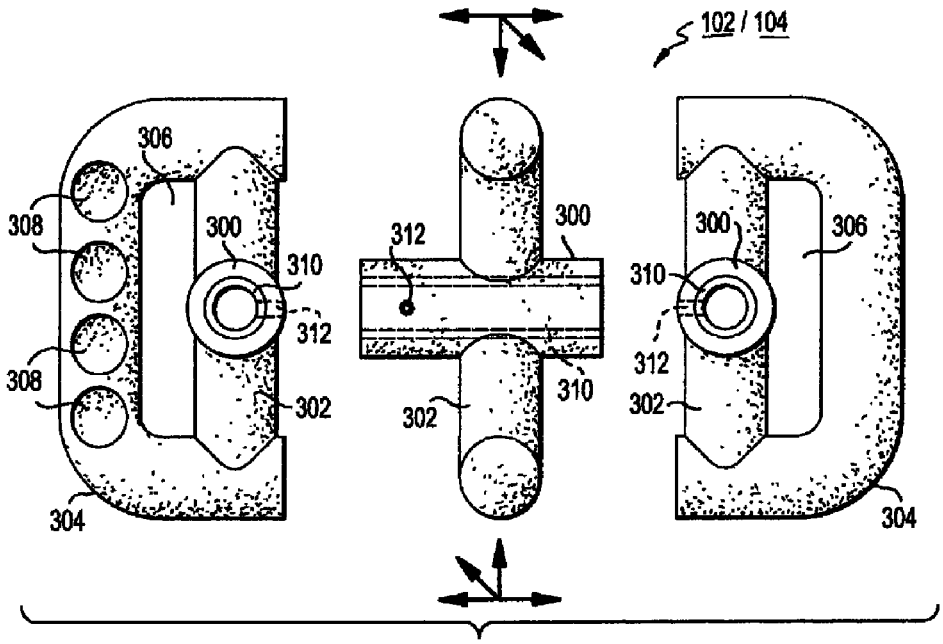
FIG. 3
FIG. 6
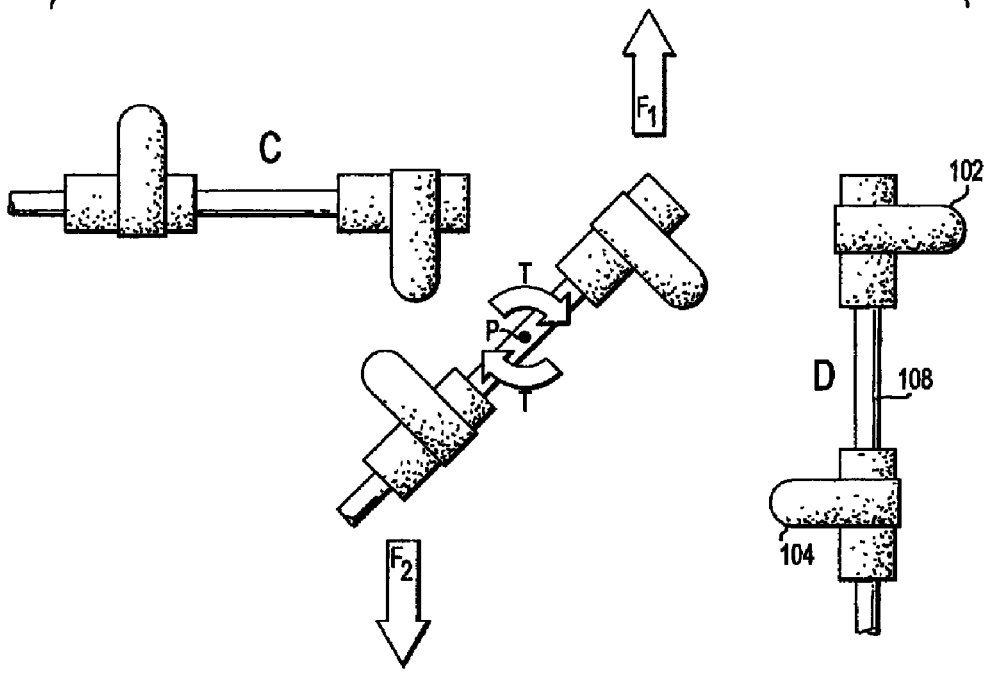

GOLF CLUB HAVING IMPROVED HANDLE CONFIGURATION

FIELD OF THE INVENTION

The present invention relates to an improved handle configuration. More particularly, the present invention relates to apparatus and method for configuring the handle of a device in a manner that increases the head speed of the device as it is swung with two hands while increasing the amount of control a user has over the device.

BACKGROUND OF THE INVENTION

It has been reported that over 2 million people per year play golf as a pastime while, simultaneously, similar numbers of people quit playing golf as a pastime. As a result, the sport of golf has enjoyed little to no growth. It is believed that the reason so many people quit the sport of golf is because of the degree of difficulty in playing a respectable game of golf.

The key to playing a respectable game of golf is the golfer's ability to get the golf ball from the tee to the pin in as few strokes as possible. And it is well known that one way to reduce the number of strokes it takes get from the tee to the pin is to hit the ball farther with each swing of the golf club. In other words, by hitting the golf ball farther each time the golfer swings the golf club, it will take the golfer less swings, or strokes, to move the golf ball from the tee to the pin.

Using the distance from the middle tees to the pin as an example, par-three holes will generally range between 100 yards and 250 yards, par-four holes will generally range between 250 yards and 450 yards, and par-five holes will generally range between 450 yards and 600 yards. And using the average amateur male golfer as an example, the distance a golfer can hit a golf ball with a driver will generally range between 150 yards and 200 yards, the distance a golfer can hit a golf ball with a 7-iron will generally range between 120 yards and 150 yards, and the distance a golfer can hit a golf ball with a pitching wedge will generally range between 80 yards and 200 yards. As those numbers demonstrate, a golfer will typically have to use different combinations of golf clubs on different holes to achieve the distances required to get the golf ball from the tee to the pin. Thus, by increasing the distance the golf ball travels each time a golfer strikes it, the golfer can not only reduce the number strokes it takes to move the ball from the tee to the pin, the golfer can also reduce the number of different clubs that must be used to get the golf ball close to the pin.

Although a significant amount of technology has been developed in an attempt to help golfers hit golf balls farther, that technology is generally limited to the materials, shapes, and sizes of the club head and shaft. In particular, that technology is directed to increasing the head speed of the golf club, increasing the "sweet spot" of the golf club head, moving the center of gravity of the club head, and improving the efficiency with which energy is transferred to the golf ball. Because the distance traveled by a golf ball is proportional to the squared value of the speed of the club head as it hits the golf ball, increasing the head speed of the golf club is one of the best ways to help golfers hit golf balls farther. Unfortunately, however, most of the technology directed to increasing the head speed of a golf club is based on improving the aerodynamics of the club head, which invariably means making it more like an airfoil profile. Accordingly, such technology presents the risk of generating lift when the airfoil is not symmetric and perfectly aligned (i.e., a zero angle of attack) with the oncoming airflow, which can make a golf club feel twitchy and less accurate.

In addition, some of the other forms of technology for helping golfers hit golf balls farther rely on golfers to produce certain head speeds before they will provide the intended benefits, thereby compounding the distance problem for golfers with low head speeds. A specific example of such a technology is the reduction of the wall thickness of certain sections of a club face to produce a spring-like effect in the club face that causes the golf club to impart a larger initial velocity on the golf ball. However, when golfers with low head speeds use such golf clubs, the deformation of the club face is so small that the effect of increasing the initial velocity of a ball is insufficient.

In addition, the technology discussed above is relatively expensive to implement, which drives up the cost of golf clubs. Moreover, that technology generally cannot be retrofit into/onto existing golf clubs. Thus, a golfer must replace his or her golf club(s) to enjoy that technology. Accordingly, there remains a need in the art for an apparatus and method that increases the head speed of golf clubs and, more particularly, that can be retrofit onto existing golf clubs.

SUMMARY OF THE INVENTION

To address at least the problems and/or disadvantages described above, it is a non-limiting object of the present invention to provide an apparatus and method for an improved handle configuration. The apparatus and method include an upper handle secured to a shaft that has a longitudinal axis and a lower handle secured to the shaft opposite the upper handle at a location spaced from the upper handle along the longitudinal axis of the shaft. The upper handle and lower handles each have grip portion that extends at an angle substantially orthogonal to the longitudinal axis and that is spaced apart from the shaft in a plane that is substantially perpendicular to the longitudinal axis. The upper handle and lower handle are secured to the shaft at an end of the shaft opposite a device configured to contact an object when the shaft is swung. Those and other objects, advantages, and features of the present invention will become more readily apparent by the following written description, taken in conjunction with the accompanying drawings and claims.

BRIEF DESCRIPTION OF THE DRAWINGS

Aspects of the present invention can be better understood with reference to the following drawings, which are part of the specification and represent preferred embodiments of the present invention:

FIG. 3 includes a bottom plan view, an elevation view, and a top plan view illustrating a handle from the handle configuration of FIG. 1;

FIG. 6 is a front plan view of the handle configuration of FIG. 1 as it travels from between two of the positions illustrated in FIGS. 5A-5E.

Figure 1:
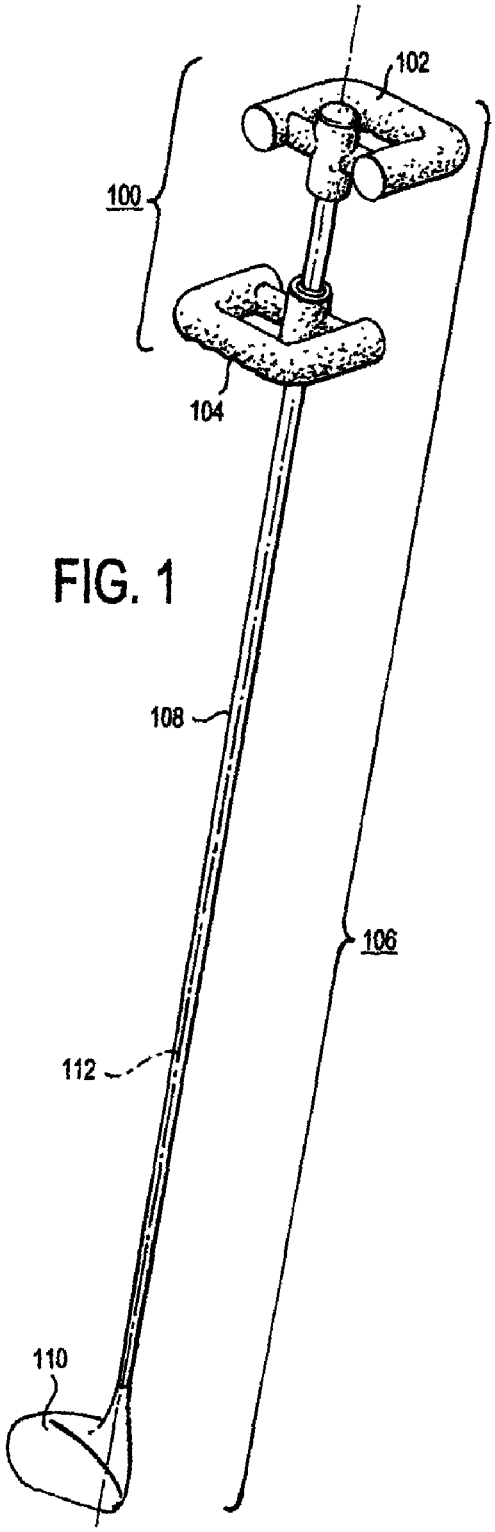
FIG. 1 is an isometric view illustrating an improved handle configuration according to a non-limiting embodiment of the present invention.

The components in the drawings are not necessarily to scale, emphasis instead being placed upon illustrating the principles of the present invention.

DETAILED DESCRIPTION OF THE PREFERRED EMBODIMENTS

The present invention overcomes the shortcomings of the prior art and provides at least the advantages discussed below by increasing the head speed of a golf club while increasing the amount of control a user has over the golf club via an improved handle configuration. The improved handle configuration of the present invention increases the head speed of a golf club by taking advantage of the geometry of a golf swing to create a whipping effect during the down swing. And the improved handle configuration increases the amount of control a user has over the golf club by eliminating some of the opportunities to introduce error into the golf swing that are present using a conventional grip. The apparatus and method can be implemented in existing golf clubs by retrofitting the an apparatus with the improved handle configuration onto existing golf clubs. Accordingly, the method and apparatus of the present invention not only increase the head speed of golf clubs, they improve a user's control over the golf club and reduce the costs of associated with enjoying the benefits of such technology.

Those and other advantages provided by the present invention can be better understood from the description of the preferred embodiments below and in the accompanying drawings. In describing the preferred embodiments, specific terminology is resorted to for the sake of clarity. However, the present invention is not intended to be limited to the specific terminology so selected, and it is to be understood that each specific term includes all technical equivalents that operate in a similar manner to accomplish a similar purpose. For example, the term "golf club" is used to describe the device with which the apparatus and method of the present invention are implemented, but the apparatus and method of the present invention may also be implemented with other devices (e.g., a field hockey stick, an ice hockey stick, a baseball bat, a cricket bat, etc.) to provide similar advantages without departing from the spirit of the invention.

A. HANDLE ASSEMBLY

Turning to the drawings, FIG. 1 is an isometric view of an improved handle assembly 100 according to a non-limiting embodiment of the present invention. The handle assembly 100 includes an upper handle 102 and a lower handle 104 secured to a golf club 106. The golf club 106 includes a shaft 108 and a club head 110. The upper handle 102 and lower handle 104 of the handle assembly 100 are disposed at the opposite end of the shaft 108 from the club head 110 in a spaced relation to each other in the direction of the longitudinal axis 112 of the shaft 108. The upper handle 102 and lower handle 104 are also disposed and on opposing sides of the shaft 108 from each other. The golf club 106 may be of substantially any make, model, size, shape, or loft. In other words, the handle assembly 100 of the present invention is suitable for use with substantially any golf club 106.

Figure 2A:
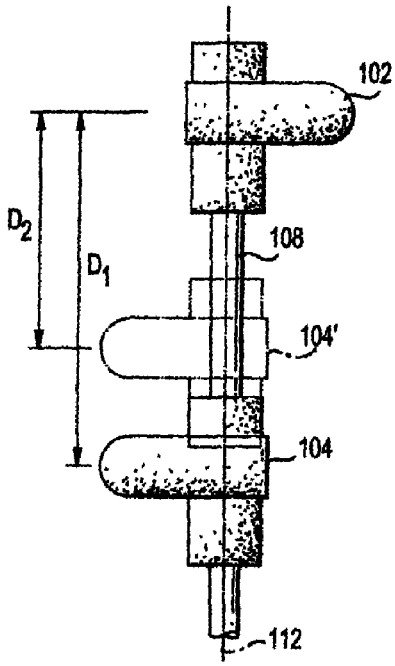
FIG. 2A is a front elevation view illustrating how the spacing of the handle configuration of FIG. 1 can be adjusted.
Figure 2B:
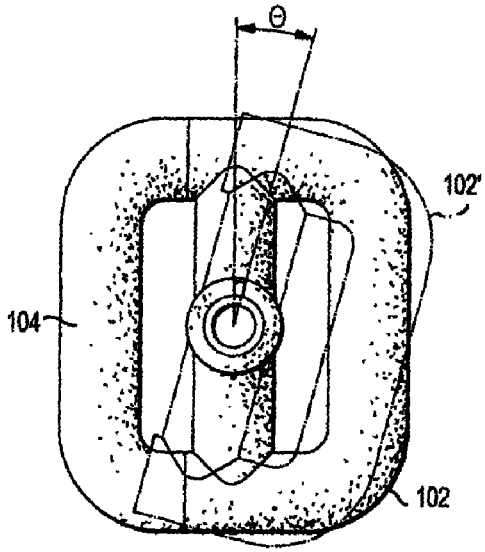
FIG. 2B is a top plan view illustrating how the angle of the handle configuration of FIG. 1 can be adjusted.

As FIGS. 2A and 2B illustrate, the upper handle 102 and lower handle 104 can be arranged with different spacing and different angular relations to each other at the end of the shaft 108 distal from the club head 110. More specifically, FIG. 2A illustrates how the lower handle 104 can be positioned at a distance $D_1$ from the upper handle 102 in the direction of the longitudinal axis 112 of the shaft 108 and how the lower handle 104' can also be positioned at a distance $D_2$ from the upper handle 102 in the direction of the longitudinal axis 112 of the shaft 108. And FIG. 2B illustrates how the upper handle 102 can be positioned parallel to the lower handle 104 on an opposite side of the longitudinal axis 112 of the shaft 108 and how the upper handle 102' can also be rotated around the longitudinal axis 112 of the shaft 108 by an angle θ with respect to the lower handle 104.

By allowing the upper handle 102 and the lower handle 104 to be positioned on the shaft 108 with spacing and angular relations to each other, the handle assembly 100 of the present invention can be configured to suit substantially any golfer's needs and/or swinging style. For example, a taller golfer may configure the upper handle 102 and the lower handle 104 farther apart along the longitudinal axis 112 of the shaft 108 than a shorter golfer. A golfer may also want to configure the upper handle 102 and the lower handle 104 farther apart along the longitudinal axis 112 of the shaft 108 to generate a greater whipping action with handle assembly 100. And a golfer who would like to intentionally slice the golf ball (e.g., a right-handed golfer who needs to start the golf ball left and have it end up to the right) may rotate the upper handle 102 and/or the lower handle 104 clockwise with respect to the face of the club head 110 so that the club face will be open at the angle of impact. Otherwise, by leaving the upper handle 102 parallel to the lower handle 104 on opposite sides of the shaft 108, the handle assembly 100 provides the advantage of preventing the golfer from slicing or hooking the golf ball by preventing the golfer's hands from twisting during the golf swing.

Although FIG. 2A shows the lower handle 104 being moved along the longitudinal axis 112 of the shaft 108 with respect to the upper handle 102, the upper handle 102 may also be moved along the longitudinal axis 112 of the shaft 108 with respect to the lower handle 104. For example, both the upper handle 102 and the lower handle 104 may be moved in the direction of the club head 110 along the longitudinal axis 112 of the shaft 108 so as to "choke down" on the golf club when the golfer would like to hit the golf ball lower and/or shorter while still enjoying the slice- and hook-preventing advantages of the handle assembly 100. And although FIG. 2B shows the upper handle 102 being rotated around the longitudinal axis 112 of the shaft 108 with respect to the lower handle 104, the lower handle 104 may also be rotated around the longitudinal axis 112 of the shaft 108 with respect to the upper handle 102. Still further, both the upper handle 102 and the lower handle can be rotated around the longitudinal axis 112 of the shaft 108 with respect to the face of the club head 110. As discussed above, such rotation can be used by a golfer to intentionally hook or slice the golf ball.

Other than being positioned on opposite sides of the shaft 108, the upper handle 102 and lower handle 104 are substantially identical to one another. And as illustrated in more detail in FIG. 3, the upper handle 102 and lower handle 104 each include a cylindrical collar portion 300, a cylindrical cross member 302, and a U-shaped cylindrical grip portion 304. The cylindrical collar portion 300 is attached to the grip portion 304 via the cross member 302 at the top of the "U" shape formed by the grip portion 304 so as to provide an open space 306 between the cross member 302 and the grip portion 304. The tips of a golfer's fingers can be received in that open space 306 when the golfer wraps his or her fingers around the bottom of the "U" shape formed by the grip portion 304. The cross member 302 and grip portion 304 lie in substantially the same plane as each other while the collar portion 300 is disposed substantially perpendicular to that plane.

The grip portion 304 includes four indentations 308 configured to ergonomically receive each of the golfer's fingers when they are wrapped around the bottom of the "U" shape formed by the grip portion 304. And when the upper handle 102 and lower handle 104 are installed on the shaft 108 of a golf club 106, the cross member 302 and the grip portion 304 lie in a plane that is substantially perpendicular to the longitudinal axis 112 of the shaft 108; the cross member 302 extends at an angle substantially perpendicular to the longitudinal axis 112 of the shaft 108; and the grip portion 304 extends at angles that are substantially tangent to a curve centered on the longitudinal axis 112 of the shaft 108. Accordingly, the upper handle 102 and lower handle 104 allow a golfer to ergonomically grip a golf club 106 in parallel planes (i.e., the plane of the upper handle 102 and the plane of the lower handle 104) that are substantially perpendicular to the shaft 108 of the golf club 106 with both of those hands being tangentially spaced from the shaft 108. That grip configuration not only causes a whipping effect, as discussed in more detail below, it is also easier to use for certain golfers as compared to conventional grip configurations. For example, it is easier for older golfers to grip a golf club 106 in parallel planes that are substantially perpendicular to the shaft 108 of the golf club 106 because eliminates the need for them to rotate their wrists. It can also reduce the amount of arm and body rotation required to hit the golf ball. Both of those advantages are discussed more below.

The upper handle 102 and lower handle 104 also each include a cylindrical reinforcing member 310 disposed within the collar portion 300 and a threaded through-hole 312 extending through both the collar portion 300 and the reinforcing member 310. The collar portion 300 includes a hollow central portion configured to concentrically and removably receive the reinforcing member 310 therein; the reinforcing member 310 includes a hollow central portion configured to concentrically and removably receive the shaft 108 of the golf club 106 therein; and the through-hole 312 is configured to make threaded engagement with a threaded fastener 402 (FIG. 4B) for removably and adjustably securing the upper handle 102 and lower handle 104 to the shaft 108 of a golf club 106. To allow the threaded fastener 402 (e.g., hex bolt, allen screw, wing screw, etc.) to pass through the through-hole 312 and make contact with the shaft 108 of the golf club 106, the through-hole 312 must be aligned between the collar portion 300 and the reinforcing member 310 when those two components are assembled. Accordingly, the collar portion 300 and the reinforcing member 310 may include mating surfaces (not shown) that only allow them to be mated with the through-hole 312 aligned, such as a ridge on the inner bore of the collar portion 300 that is configured to be received in a groove on the outer surface of the reinforcing member 310.

As discussed above, the upper handle 102 and the lower handle 104 are substantially identical to each other. However, the reinforcing members 310 may differ slightly between the upper handle 102 and the lower handle 104. More specifically, the shaft 108 of a golf club 106 is typically tapered so that it grows thinner along its longitudinal axis 112 in a direction toward the club head 110. Accordingly, the inner bore of the reinforcing member 310 may be tapered to match the contour of the shaft 108, with the reinforcing member 310 in the upper handle 102 having larger inner diameters than the reinforcing member 310 in the lower handle 104. But because the other portions 300-304 of the upper handle 102 and lower handle 104 are the same—in particular, the inner bore of the collar portion—the outer surface of the reinforcing members 310 need not be tapered and need not have a different diameter for use with the upper handle 102 or lower handle 104.

That configuration allows the upper handles 102 and lower handles 104 to be swapped between golf clubs 106 of different makes, models, sizes, shapes, and lofts using different reinforcing members 310 with different bore shapes (e.g., tapered and circular, straight and circular, tapered and triangular, etc.) of different sizes, which reduces the costs for a user to enjoy the benefits of the present invention with a plurality golf clubs. Moreover, it allows the upper handle 102 and lower handle 104 to be made substantially identical to each other, which reduces manufacturing costs. To further reduce costs, the reinforcing members 310 may be provided as a kit with an upper handle 102 and lower handle 104, wherein each of those kits is configured to fit golf clubs 106 of different loft of a specific make and/or model such that a user only needs to purchase one kit for his or her make and/or model of golf clubs 106.

The collar portion 300, cylindrical cross member 302, and grip portion 304 are preferably formed integrally as a single part using a strong, light-weight material so as to facilitate the efficient transfer of energy from the golfer to the golf club. The reinforcing member 310 is preferably made of a stronger material than the collar portion 300, cylindrical cross member 302, and grip portion 304 so as to add strength and rigidity to the upper handle 102 and lower handle 104 without requiring those other components 300-304 to be made of that stronger material. The collar portion 300, cylindrical cross member 302, and grip portion 304 are preferably made of plastic (e.g., HDPE) and formed by injection molding, and the reinforcing member 310 is preferably made out of aluminum (e.g., Grade 6061 aluminum) by machining. Other materials and processes may also be used.

Forming the reinforcing member 310 separately from the collar portion 300, cylindrical cross member 302, and grip portion 304 not only allows the reinforcing members 310 to be made interchangeable so a golfer can swap the upper handle 102 and lower handle 104 between different golf clubs 106, as discussed above, it also provides an economical way to add strength and rigidity to the upper handle 102 and lower handle 104 without adding significant weight or cost. In the alternative, the reinforcing member 310 can be eliminated and the collar portion 300, cylindrical cross member 302, and grip portion 304 can be formed integrally as a single part configured for a specific golf club 106 using more expensive, high-strength materials throughout (e.g., carbon fiber, titanium, etc.). Such a configuration is not only more expensive, it would also require different upper handles 102 and lower handles 104 to be manufactured for each different type of golf club 106. Accordingly, the reinforcing member 310 is preferably made separately from the collar portion 300, cylindrical cross member 302, and grip portion 304.

B. METHOD OF ASSEMBLING THE HANDLE ASSEMBLY

Figure 4A:
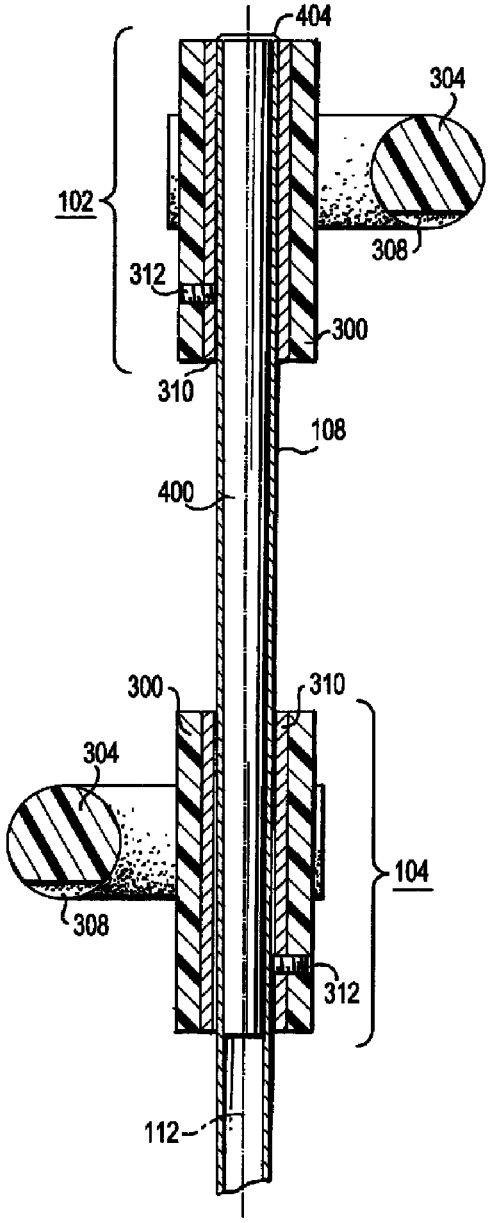
FIG. 4A is a sectional plan view of the handle configuration of FIG. 1 illustrating how that handle configuration is assembled.
Figure 4B:
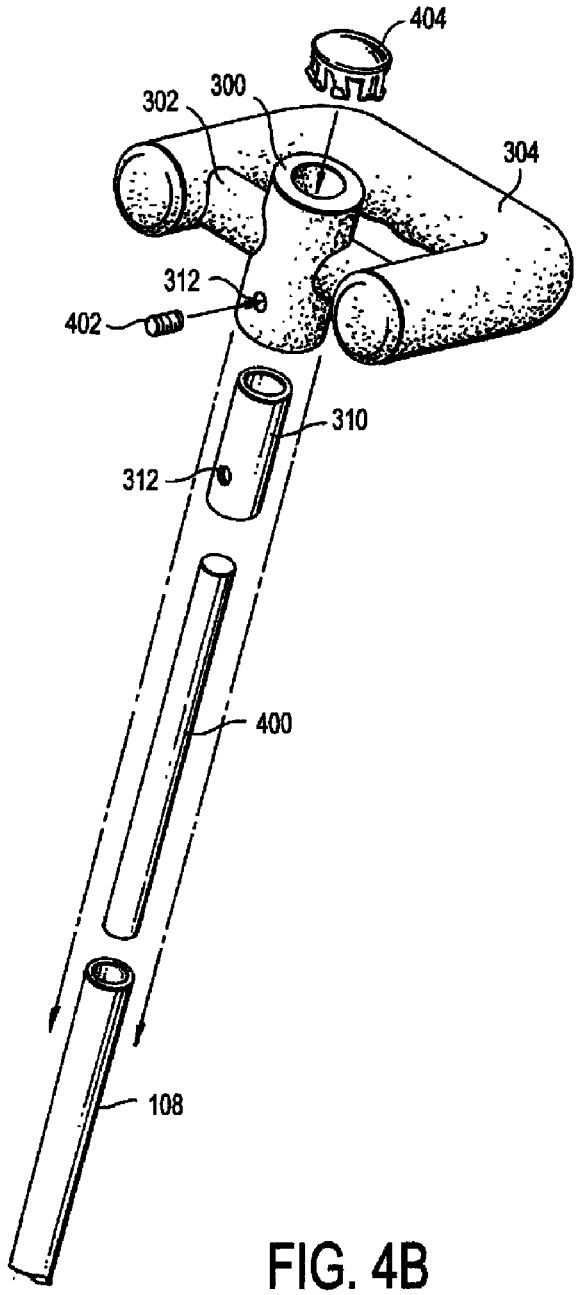
FIG. 4B is an exploded isometric view of the handle configuration of FIG. 1 illustrating how that handle configuration is assembled.

As FIGS. 4A and 4B illustrate, securing the upper handle 102 and lower handle 104 to the shaft 108 of a golf club 106 includes inserting a cylindrical backing member 400 into the inner bore of the hollow shaft 108. The outer surface of the backing member 400 is preferably contoured to match the shape of the inner bore of the shaft 108 so as to provide a close tolerance fit. The backing member 400 is also preferably only as long as required to extend into the shaft 108 of the golf club 106 far enough to have a portion thereof disposed concentrically adjacent to the collar portion 300 of the lower handle 104. The backing member 400 is installed in the inner bore of the shaft 108 to provide additional strength to the shaft 108 when the upper handle 102 and lower handle 104 are secured to the shaft 108 so the threaded fastener 402 does not bend or otherwise damage the shaft 108 when tightened down. The backing member 400 is a solid metal rod that is held within the inner bore of the shaft 108 with a hole plug 404 installed at the distal end of the shaft 108.

As discussed above, different golf clubs 106 may have different sized and shaped shafts 108. Accordingly, backing members 400 may be provided in a kit to fit golf clubs 106 of different makes, models, sizes, shapes, and lofts. Similarly, a backing member 400 may be paired with a specific set of reinforcing members 310 to fit a specific golf club 106. Moreover, one of those reinforcing members 310 may have a different bore than the other so as to provide a close tolerance fit with the shaft 108 in areas of the golf club 106 with different taper (e.g., larger diameters in the reinforcing member 310 used with the upper handle 102 and smaller diameters in the reinforcing member 310 used with the lower handle 104). Such reinforcing members 310 and their corresponding backing member 400 are preferably marked (e.g., numbers, letters, etc.) so a user knows which reinforcing members 310 to use with which backing member 400 for a specific golf club 106.

With the proper combination of reinforcing members 310 chosen, they are installed on the upper handle 102 and lower handle 104. Because the upper handle 102 and lower handle 104 are substantially identical (other than the inner bores of the reinforcing members 310), which of those handles is the upper handle 102 or lower handle 104 is determined by which reinforcing member 310 is installed therein. The lower handle 104 is placed on the shaft 108 first, followed by the upper handle 102, by sliding them over the shaft 108 along the longitudinal axis 112 of the golf club 106 in the direction of the club head 110. If the golf club 106 includes a grip at the distal end of the shaft 108, it may need to removed to allow the upper handle 102 and lower handle 104 to slide down the shaft 108 and properly seat on the golf club 106.

The taper of the reinforcing member 310 will determine the furthest point down the shaft 108 of the golf club 106 at which the upper handle 102 and lower handle 104 can be positioned, wherein the upper handle 102 and lower handle 104 will not be able to move beyond a position on the shaft 108 at which the outer diameter of the shaft 108 is equal to or greater than the inner diameter of the reinforcing member 310. With the upper handle 102 and lower handle 104 in the desired positions with respect to each other and the club head 110, the threaded fasteners 402 of the upper handle 102 and lower handle 104 are tightened to removably hold them in those positions. It is not necessary for the upper handle 102 and lower handle 104 to be at the furthest point down the shaft 108 at which they can be positioned when their respective threaded fasteners 402 are tightened, but doing so provides the benefit of centering the upper handle 102 and lower handle 104 on the shaft 108 via the resulting contact between the inner bore of the reinforcing member 310 and the outer surface of the shaft 108.

In the alternative, neither the reinforcing members 310 nor the backing member 400 need to be tapered to fit a specific golf club 106. Instead, the inner bore of the reinforcing members 310 and the outer surface of the backing member 400 can have substantially constant diameters and be provided in standard sizes. In that configuration, a plurality of through-holes 312 could be spaced equidistantly from each other around the circumference of the collar portion 300 and reinforcing member 310 so that a plurality of threaded fasteners 402 could be used to center the upper handle 102 and/or lower handle 104 on the shaft 108 of the golf club 106, such as by tightening the threaded fasteners 402 on one side of the shaft 108 while loosening the threaded fasteners on the other side of the shaft 108. Although that alternative configuration requires the additional step of centering upper handle 102 and lower handle 104 of the shaft 108 of the golf club 106, it provides the added advantages of allowing the upper handle 102 and lower handle 104 to be centered at multiple different locations on the shaft 108 of the golf club 106. Moreover, it greatly reduces the number of reinforcing members 310 and backing members 400 that need to be provided to accommodate different golf clubs 106 with different shafts 108.

As discussed above, the upper handle 102 and lower handle 104 can be installed in line with the face of the club head 110 to hit the golf ball straight and prevent the golfer from hooking or slicing the ball. Or one or both of those handles 102 or 104 can be set at an angle θ with respect to each other and/or the face of the club head 110 to intentionally cause the golfer to hook or slice the golf ball. To allow such adjustments to be quickly and easily made on the golf course, the threaded fasteners 402 may be provided as wing screws. In the alternative, the golfer may carry a small tool in his or her golf bag for conveniently making such adjustments.

Regardless of the position or the method of securing the upper handle 102 and lower handle 104 to the shaft 108 of the golf club 106, they should be sufficiently secure to ensure that they do not move during the golf swing such that the golfer's hands do not move away from or toward each other during the golf swing or rotate with respect to each other during the golf swing. Preventing the golfer's hands from moving in that manner ensures that the golfer can transfer the maximum amount of energy to the golf club 106 using the upper handle 102 and lower handle 104. It also ensures that the golfer has the maximum amount of control of the golf club 106 using the upper handle 102 and lower handle 104.

Also when installing the upper handle 102 and lower handle 104 on a golf club 106, the grip portion 304 of the upper handle 102 should be facing the same direction as the face of the club head 110 and the grip portion 304 of the lower handle 104 should by facing the opposite direction. Regardless of whether the golfer is right-handed or left-handed, that configuration will ensure that the golfer's leading hand is above the golfer's trailing hand. A golfer's leading hand is the hand that "leads" the pair of hands through the forward golf swing, wherein the back of that hand faces the direction of intended flight of the golf ball. And a golfer's trailing hand follows the leading hand through the forward golf swing, wherein the back of that hand faces away from the direction of intended flight of the golf ball.

Preferably, the upper handle 102 will be located on the shaft 108 of the golf club 106 at a position that allows the golfer's leading arm (i.e., the arm of the leading hand) to be substantially straight during the backswing. And the lower handle 104 will preferably be located on the shaft 108 of the golf club 106 at a position that allows the golfer's trailing arm (i.e., the arm of the trailing hand) to be substantially straight when holding the golf club at the angle of impact. That positioning helps produce the whipping effect of the present invention, as discussed in more detail below. If a portion of the shaft 108 extends beyond the upper handle 102 along its longitudinal axis 112 in a direction away from the club head 110 in that position, that portion of the shaft 108 may need to be removed to prevent it from interfering with the golf swing.

C. METHOD OF USING THE HANDLE ASSEMBLY

Figures 5A, 5B, 5C:
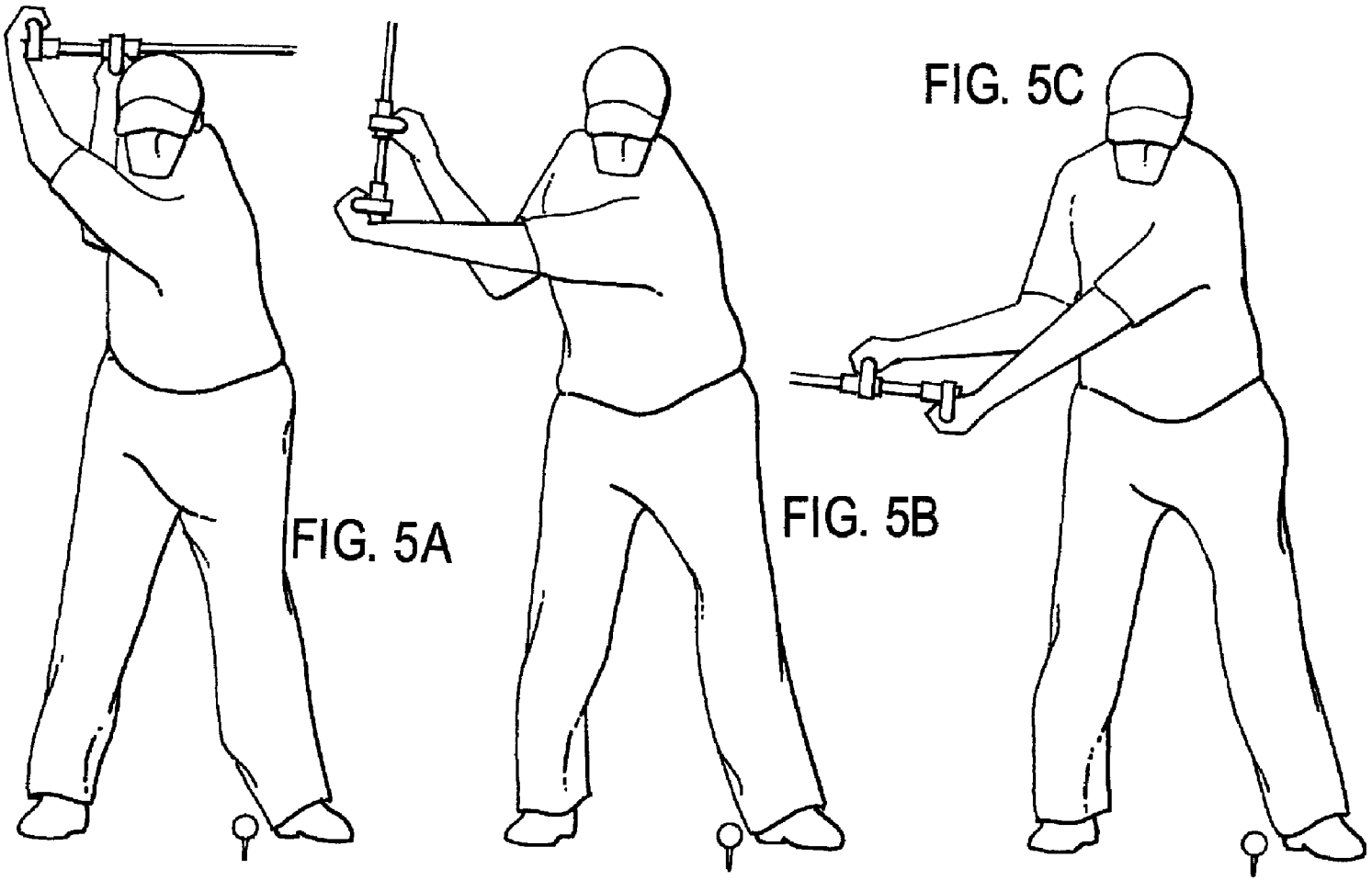
FIGS. 5A-5E are front plan views of a golfer's different positions during a partial golf swing using the handle configuration of FIG. 1.

In operation, the unique handle assembly 100 of the present invention produces a whipping effect during a golf swing by guiding a golfer's hands through a push-pull motion during the down swing that causes additional rotation of the golf club 106 within the arc of the swing, thereby dramatically increasing the head speed of the golf club 106 as it approaches the angle of impact. As FIGS. 5A and 5B illustrate, that push-pull motion is produced as the golfer's leading arm goes from straight to bent and the golfer's trailing arm goes from bent to straight during the down swing, thereby causing the golfer's hands to move relative to each other like a pair of reciprocating pistons. As a result, the golf club 106 rotates about a point "P" in between the upper handle 102 and the lower handle 104 as the golf club 106 moves through the arc of the swing, thereby causing a whipping effect that additively accelerates the club head 110 with respect to the acceleration that is already being imparted to the club head 110 as it moves through the arc of the golf swing.

In more detail, a golfer first grips the handle assembly 100 by wrapping the fingers of his or her leading hand around the grip portion 304 of the upper handle 102 and wrapping the fingers of his or her trailing hand around the grip portion 304 of the lower handle 102. As discussed above, the grip portions 304 of the upper handle 102 and lower handle 104 are tangentially spaced from the shaft 108 and oriented in a plane that is substantially perpendicular to the longitudinal axis 112 of the shaft 108 such that the golfer's hands will be substantially perpendicular to the shaft 108 of the golf club 106 when he or she grips the upper handle 102 and lower handle 104. And as also discussed above, the grip portions 304 of the upper handle 102 and lower handle 104 are oriented substantially parallel to the face of the club head 110 (unless the golfer is intentionally trying to slice or hook the golf ball) such that the back of the golfer's leading hand will face the direction of intended flight of the golf ball and the back of the golfer's trailing hand will face away from the direction of intended flight of the golf ball. That grip eliminates the need for the golfer to bend his or her wrists when swinging the golf club 106, making the handle assembly 100 of the present invention more natural and comfortable than a conventional golf grip.

With the handle assembly 100 firmly gripped in the golfer's hand, the golfer begins the backswing with the elbow of his or her leading arm straightened. Although the golfer's grip should be firm, it should not be so firm that the upper handle 102 and lower handle 104 cannot rotate in the golfer's hand during the backswing and downswing. As a result, the elbow of the golfer's trailing arm can bend during the backswing. And, as the elbow of the golfer's trailing arm bends, the golf club 106 will pivot around the grip portion 304 of the upper handle 102 (i.e., the golfer's leading hand), thereby allowing the golfer to move the golf club 106 to the top of the backswing (e.g., a position where the longitudinal axis 112 of the shaft 108 is at or near parallel to the ground) with less rotation of his or her arms and body than would be required using a conventional grip. Reducing the amount of rotation required for a golfer to reach the top of the backswing is particularly useful for golfers with backswing restriction due to physical limitations or age. In the alternative, the golfer can make the top of the backswing a larger angle (i.e., an angle beyond parallel) with the same amount of rotation required using a conventional grip.

Using a conventional grip, the backswing typically begins with an early backward wrist break so that the golfer reaches the top of the backswing with his or her trailing hand under the shaft 108, his or her leading hand in a straight line with the leading arm, and the face of the club head 110 at a 45-degree angle with the ground. It is of vital importance for the golfer to maintain that wrist position through the downswing so that the face of the club head 110 is square with the golf ball at the angle of impact (i.e., the angle of the golf club 106 when it returns to the golfer's address position). If that wrist position is lost (e.g., if the left wrist collapses and bends backward) the face of the club head 110 will open and alter the direction of the shot from its intended course.

By contrast, the handle assembly 100 of the present invention eliminates the need for the golfer to break his or her wrists at any point during the golf swing. The handle assembly 100 of the present invention also prevents the face of the club head 110 from changing angles during the golf swing. Accordingly, the handle assembly 100 of the present invention eliminates some of the opportunities to introduce error into a golf swing that are present with a conventional golf grip.

Turning to FIGS. 5A and 5B, a partial golf swing is shown at different positions using the handle assembly 100 of the present invention. That partial golf swing includes the motion from the top of the backswing (Position A) to the midpoint of the follow-through (Position E). Accordingly, it includes the down swing (Positions A-D) and a portion of the follow through (Positions D-E). The downswing (Positions A-D) ends at the angle of impact (Position D) and the follow-through (Positions D-E) begins at the angle of impact (Position D).

Figure 5E:
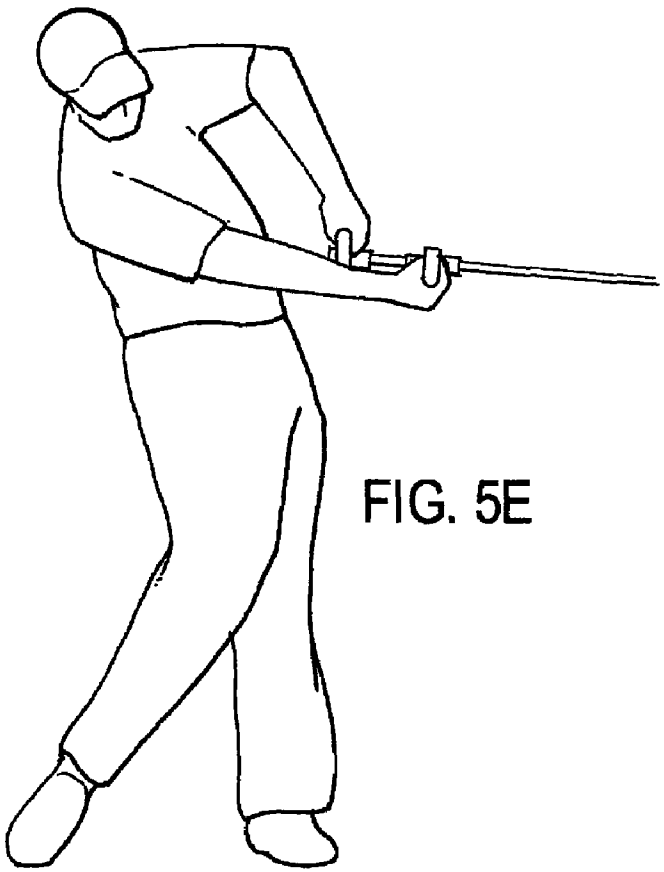
Figure 5D:
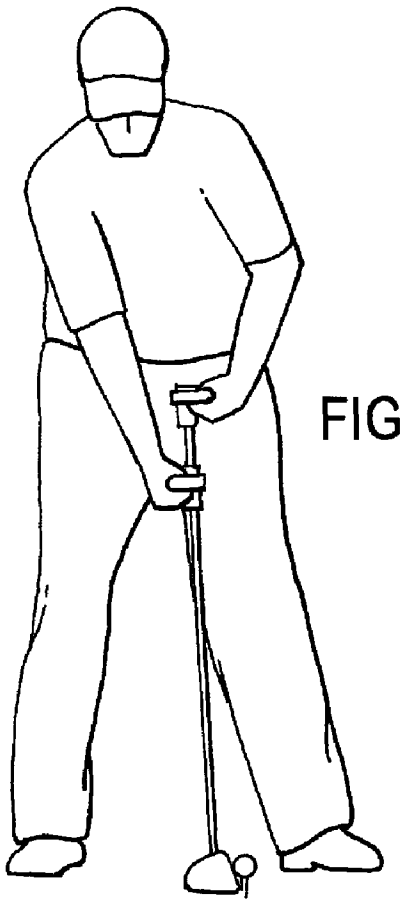

As FIGS. 5A-5E illustrate, the golfer's trailing arm transitions from bent to straight during the downswing (FIGS. 5A-5D, Positions A-D) and the golfer's leading arm transitions from straight to bent during the downswing (FIGS. 5A-5D, Positions A-D). The golfer's trailing arm transitions from being bent at the elbow at the top of the backswing (FIG. 5A, Position A) to being straight at the elbow at the angle of impact (FIG. 5D, Position D) and continuing through to the midpoint of the follow-through (FIG. 5E, Position E). The golfer's leading arm, however, remains straight through the 9 o'clock position (FIG. 5B, Position B) and does not begin to bend until after the 7 o'clock position (FIG. 5C, Position C), whereby it continues to bend through to the midpoint of the follow-through (FIG. 5E, Position E). Thus, the golfer's leading hand and trailing hand move relative to each other like a pair of reciprocating pistons primarily between the 7 o'clock position (FIG. 5C, Position C) and the angle of impact (FIG. 5D, Position D).

As FIG. 6 illustrates, the golfer's leading hand exerts an upward force $F_1$ on the upper handle 102 and the golfer's trailing hand exerts a downward force $F_2$ on the lower handle 104 as the golfer's leading arm bends and trailing arm straightens between the 7 o'clock position (FIG. 5C, Position C) and the angle of impact (FIG. 5D, Position D). Those forces $F_1$ and $F_2$ generate a torque T that causes the golf club 106 to rotate about a point P between the upper handle 102 and the lower handle 104. That rotation is additive to the rotation of the golf club 108 generated by the golfer rotating his or her arms and body, thereby causing a whipping effect that additively accelerates the club head 110 with respect to the acceleration that is being imparted the club head 110 by the golfer rotating his or her arms and body. A conventional golf grip only provides the latter type of acceleration. Accordingly, the handle assembly 100 of the present invention not only eliminates some of the opportunities to introduce error into a golf swing that are present with a conventional golf grip, it also generates greater head speed than can be achieved with a conventional golf grip.

D. SUMMARY

The present invention provides an apparatus and method for configuring the handle of a device in a manner that increases the head speed of the device as it is swung with two hands while increasing the amount of control a user has over the device. The present invention increases the head speed of the device by creating a whipping action that additively rotates the end of the device within the arc of rotation already being experienced by the device as it is swung. And the present invention increases the amount of control a user has over the device by eliminating the need for the user to break his or her wrists at any point while swinging the device. Those advantages are particularly useful to older users who may have a limited range of motion.

As the exemplary embodiment demonstrates, the apparatus and method of the present invention are particularly suited for use with a golf club 106. The increased head speed and control allow a golfer to hit a golf ball farther and straighter, thereby decreasing the level of difficulty required to play a respectable game of golf. Moreover, because they can be implemented using a golf club 106 of substantially any make, model, size, shape, or loft, the apparatus and method of the present invention can be combined with various other forms of golf-related technology (e.g., the reduction of the wall thickness of certain sections of a club face) to further increase control and head speed, thereby further improving the golfer's golf game.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents. For example, the present invention can be used with other devices where it is desired to increase head speed, including other sports devices.

What is claimed is:

1. A handle assembly comprising:

an upper handle secured to a shaft that has a longitudinal axis, the upper handle having a grip member that extends at an angle substantially orthogonal to the longitudinal axis and that is spaced apart from the shaft in a that is plane substantially perpendicular to the longitudinal axis; and a lower handle secured to the shaft opposite the upper handle and at a location spaced from the upper handle along the longitudinal axis of the shaft, the lower handle having a grip member that extends at an angle substantially orthogonal to the longitudinal axis and that is spaced apart from the shaft in a that is plane substantially perpendicular to the longitudinal axis, wherein the upper handle and lower handle are secured to the shaft at an end of the shaft opposite a device configured to contact an object when the shaft is swung.

2. The handle assembly of claim 1, wherein the upper handle and lower handle each include a collar portion that is disposed substantially parallel to the longitudinal axis of the shaft and that is configured to fit around the shaft.

3. The handle assembly of claim 2, wherein the grip members of the upper handle and lower handle are each formed substantially in the shape of a "U" and are attached to the collar portion via a cross member at an upper portion of the "U" so as to form a space between a lower portion of the "U" and the cross member.

4. The handle assembly of claim 3, wherein the upper handle and lower handle each include indentations on a bottom surface of their respective grip members that are configured to receive a user's fingers when those fingers are wrapped around the lower portion of the "U".

5. The handle assembly of claim 2, wherein the upper handle and lower handle each include a cylindrical reinforcing member portion that is removably disposed within the collar portion and that is configured to fit between the collar portion and the shaft.

6. The handle assembly of claim 5, wherein each of the reinforcing members is made of a stronger material than the collar portions.

7. The handle assembly of claim 5, wherein each of the reinforcing members includes:

an inner bore of substantially constant diameter; and an outer surface of substantially constant diameter.

8. The handle assembly of claim 5, wherein each of the reinforcing members includes:

an inner bore that is tapered to conform to a shape of the shaft; and an outer surface that is configured to conform to an inner bore of the collar portion.

9. The handle assembly of claim 8, wherein the inner bores of the collar portions have diameters that are substantially the same; and the inner bores of the reinforcing members have diameters that are substantially the same.

10. The handle assembly of claim 1, wherein the upper handle and lower handle are both removably and adjustably secured to the shaft using one or more threaded fasteners.

11. The handle assembly of claim 1, wherein the shaft includes:

a front portion facing away from a user, a rear portion facing toward the user, and a pair of opposing sides extending between the front portion and rear portion;

the upper handle is positioned with its grip member on one of the opposing sides; and the lower handle is positioned with its grip member on the other of the opposing sides.

* * * * *

UNITED STATES PATENT AND TRADEMARK OFFICE

CERTIFICATE OF CORRECTION

PATENT NO. : 8,105,179 B1
APPLICATION NO. : 13/151978
DATED : January 31, 2012
INVENTOR(S) : Donald T. Allen It is certified that error appears in the above-identified patent and that said Letters Patent is hereby corrected as shown below:

Claim 1, col. 11, lines 51-52, change “that is plane” to --plane that is--.

Claim 1, col. 12, line 1, change “that is plane” to --plane that is--.

Signed and Sealed this
Eighteenth Day of September, 2012

David J. Kappos

David J. Kappos
*Director of the United States Patent and Trademark Office*